US011612977B2

(12) United States Patent
Fessler-Knobel et al.

(10) Patent No.: US 11,612,977 B2
(45) Date of Patent: Mar. 28, 2023

(54) METHOD FOR SMOOTHING A SURFACE OF A COMPONENT

(71) Applicant: MTU Aero Engines AG, Munich (DE)

(72) Inventors: Martin Fessler-Knobel, Munich (DE); Joerg Windprechtinger, Munich (DE); Georg Asti, Geneva (CH)

(73) Assignee: MTU Aero Engines AG, Munich (DE)

( * ) Notice: Subject to any disclaimer, the term of this patent is extended or adjusted under 35 U.S.C. 154(b) by 590 days.

(21) Appl. No.: 16/784,704

(22) Filed: Feb. 7, 2020

(65) Prior Publication Data

US 2020/0254581 A1 Aug. 13, 2020

(30) Foreign Application Priority Data

Feb. 8, 2019 (DE) ..... 10 2019 201 656.1

(51) Int. Cl.

| | |
|---|---|
| ***B24B 31/12*** | (2006.01) |
| ***B24B 31/00*** | (2006.01) |
| ***B24B 31/14*** | (2006.01) |
| ***B24B 37/02*** | (2012.01) |
| ***F01D 5/14*** | (2006.01) |
| ***F01D 9/02*** | (2006.01) |

(52) U.S. Cl.

CPC ..... *B24B 31/12* (2013.01); *B24B 31/003* (2013.01); *B24B 31/14* (2013.01); *B24B 37/02* (2013.01); *F01D 5/14* (2013.01); *F01D 9/02* (2013.01); *F05D 2230/10* (2013.01)

(58) Field of Classification Search

CPC ..... B24B 31/12; B24B 31/003; B24B 31/14; B24B 37/02; B24B 19/14; B24B 31/116; F01D 5/14; F01D 9/02; F05D 2230/10

See application file for complete search history.

(56) References Cited

U.S. PATENT DOCUMENTS

| | | | | |
|---|---|---|---|---|
| 5,341,602 | A | 8/1994 | Foley | |
| 6,464,570 | B1 | 10/2002 | Shaw et al. | |
| 6,729,937 | B2 | 5/2004 | Kawasaki | |
| 6,764,384 | B1 * | 7/2004 | Kleer | F04D 29/321 451/36 |
| 2005/0255797 | A1 | 11/2005 | Kawasaki et al. | |
| 2011/0244770 | A1 * | 10/2011 | Boutaghou | C09K 3/1454 51/307 |
| 2014/0323022 | A1 * | 10/2014 | Rizzo, Jr. | B23P 6/002 451/541 |

(Continued)

FOREIGN PATENT DOCUMENTS

| | | | |
|---|---|---|---|
| DE | 69416578 | T2 | 1/2000 |
| DE | 102008017475 | A1 | 10/2009 |

(Continued)

*Primary Examiner* — Jacob M Amick
*Assistant Examiner* — Charles J Brauch
(74) *Attorney, Agent, or Firm* — Barlow, Josephs & Holmes, Ltd.; David R. Josephs

(57) ABSTRACT

The present invention relates to a method for smoothing a surface of a component, in which a component is placed in a liquid-solids mixture; a relative movement is produced between the liquid-solids mixture and the component; thus there is a flow of the liquid-solids mixture along the surface; wherein there is provided in the liquid-solids mixture a guide surface, along which the liquid-solids mixture flows, wherein a directional component toward the surface is imposed on the flow.

12 Claims, 3 Drawing Sheets

(56) References Cited

U.S. PATENT DOCUMENTS

2019/0308292 A1* 10/2019 Nagalingam ..... B08B 9/0322

FOREIGN PATENT DOCUMENTS

| | | | |
|---|---|---|---|
| EP | 2216136 | B1 | 1/2015 |
| EP | 2848367 | B1 | 3/2016 |
| EP | 3348928 | A1 | 7/2018 |
| JP | S5216098 | A | 2/1977 |
| JP | 200417196 | A | 1/2004 |
| JP | 4059421 | B2 | 3/2008 |
| WO | 2014184067 | A1 | 11/2014 |

* cited by examiner

METHOD FOR SMOOTHING A SURFACE OF A COMPONENT

BACKGROUND OF THE INVENTION

The present invention relates to a method for smoothing a component surface.

Various methods are known for the smoothing of components: for example, a removal of material can be produced with a geometrically specific or nonspecific cutting by machining. Uneven places on the surface are removed with the removal of material; thus, the surface is smoothed, In the case of chemical-mechanical polishing, this smoothing can be produced by a combination of chemical and mechanical effects on the component surface. The present subject is directed toward such a method, wherein it particularly concerns the smoothing of components of turbomachines or engines.

A turbomachine can be functionally divided into compressor, combustion chamber and turbine, wherein, in the case of an aircraft engine, aspirated air is compressed in the compressor and is combusted in the downstream combustion chamber with kerosene mixed in. The hot gas that arises, a mixture of combustion gas and air, flows through the downstream turbine and is thereby expanded. The turbine and the compressor are usually each constructed of multiple stages, wherein one particular stage comprises a ring of guide vanes and a ring of rotating blades. Each ring is constructed from a plurality of blades or vanes circumferentially following each other, the blades or vanes surrounded by the flow of the compressor gas or hot gas, depending upon where they are used. A smoothing of these component surfaces, for example, can be of advantage aerodynamically.

SUMMARY OF THE INVENTION

The present invention is based on the technical problem of specifying an advantageous method for smoothing a surface of a component.

This is solved according to the method of the present invention. In this case, the component is placed in a container (bath) containing a liquid-solids mixture, and a relative movement is produced between the mixture and the component. The mixture flows along the surface to be smoothed, whereby a combined chemical-mechanical removal of material can be achieved: the component is chemically-mechanically polished. According to the invention, in this case, a guide surface is or will be provided in the bath or container holding the mixture, and the mixture flows along this guide surface. The guide surface guides the flow and, in particular, in this case, presses the solid constituents to the component surface, thus imposing on them a directional component toward the component surface.

The mixture, and thus the solids fraction in particular, is guided by the guide surface onto the component surface, so that a sufficient pressure is achieved for the removal of material. The solids fraction can be provided, e.g., in particle form, in particular as spherical particles, wherein, with a sufficiently high pressure, the spheres then roll out on the component surface due to the guidance so that the desired polishing effect is obtained. The solids fraction in the mixture, in particular, can be high enough, so that a coherent agglomeration of the particles or spheres is present between the guide surface and the surface of the component; thus a force chain forms between guide surface and component, so that the particles/spheres are reliably pressed against the component surface. For example, the guide surface can produce or help adjust a more uniform pressure out over the component surface, which can improve the homogeneity of the smoothing result.

For illustration: for example, if one were to place a blade element in the mixture without a guide surface and produce a flow in a way comparable to the arrangement in the gas channel (inflow at the leading edge and outflow at the trailing edge), the pressure and therefore the removal of material would be high at the leading edge. Toward the trailing edge, however, it would decrease, which would result in an overall nonuniform removal. Nevertheless, in order to achieve a certain homogenization, the component then needs to be subjected to flow, for example, in different orientations, without employing a guide plate, which means an added expense as well as a lengthy processing. With the guide plate, in contrast, the flow can be adjusted, so that in the ideal case, hardly any reorientation of the component is necessary; therefore, a uniform removal of material is achieved in a single relative arrangement or orientation.

Preferred embodiments of the invention are found in the dependent claims and in the overall disclosure, wherein, in the presentation of the features, a distinction is not always made in the individual case between method and device aspects; in any case, the disclosure should be read implicitly with respect to all claim categories. For example, if specific means that are employed in the method are described, this description is also to be understood as disclosure of a device equipped with the corresponding means for carrying out the method.

In the scope of this disclosure, "a" and "one", unless expressly indicated otherwise, are to be read as the indefinite article and thus also are always to be read as "at least a" or "at least one". Thus, for example, a plurality of components also can be arranged in the bath and smoothed simultaneously. If the component involves a blade element, this portion of an individual blade or of a multiple segment can be processed; in principle, in fact, even a complete blade ring can be processed (blisk, blade integrated disk).

As already mentioned, the component can preferably involve a blade element or vane body of a turbomachine, this blade element or vane body being arranged in the gas channel thereof and subjected to flow. In principle, an application in the turbine region is also conceivable; the blade element or vane body thus can be arranged in the hot-gas channel and surrounded by the flow of hot gas. Preferably, one application is in the compressor region; the blade element or vane body is thus surrounded by the flow of compressor gas in the compressor-gas channel. The advantages of the method according to the invention can particularly come to bear here; namely, the homogeneously smoothed component surface can help prevent a break in the flow or a flow separation, for example.

In a preferred embodiment, the guide surface is a lateral surface of a guide unit that is subjected to flow in the bath. The latter means that the liquid-solids mixture flows not only along the guide surface, but also along a lateral surface opposite to the guide surface. The guide unit is preferably made of metal; it may involve, in particular, a guide plate (simple and flexible manufacture).

In a preferred embodiment, the component surface has a curved course when observed in a sectional plane, and the guide surface has a complementary curvature when observed in the same sectional plane. If, for example, the surface is convex, then the guide surface is concave, and in the case of a concave component surface, it extends in a convex manner. Said sectional plane preferably lies parallel to the direction of flow; in the case of the blade element, it may involve, for example, a tangential sectional plane (the profile of the blade element is observed in this plane; the sectional plane lies tangential to a circumference around the longitudinal axis or axis of rotation of the turbomachine).

In a preferred embodiment, the guide surface is arranged relative to the component surface in such a way that the distance therebetween decreases in the flow direction. Concretely, when observed in the section (see the preceding paragraph relative to the sectional plane), the distance is taken perpendicular to the flow lines between the component surface and the guide surface. A distance that continually decreases in the flow direction (without gaps/steps) may be preferred, which can offer advantages with respect to the desired homogenization.

According to a preferred embodiment, another guide surface is provided in the bath, and this can also be formed from a guide unit, in particular from a guide plate. In this case, the component is or will be arranged between the guide surfaces relative to a direction perpendicular to the flow direction. The flow is then guided from one guide surface to a surface region of the component, and from the other guide surface to a component surface region opposite thereto. In the case of the blade element, one guide surface can be assigned to the surface on the suction side and the other to the surface on the pressure side.

In a preferred embodiment, the guide surfaces between which the component is placed are arranged relative to one another in such a way that the distance between them decreases in the flow direction. Concretely, when considered in the section, this distance between the guide surfaces is taken perpendicular to the flow lines; see also the preceding remarks. Thus, for example, if a blade element is smoothed and flow enters at the leading edge for this purpose, the distance between the guide surfaces arranged on both sides thereof decreases from the leading edge to the trailing edge. Preferably, in this case, the distance between the guide surface and the respective component surface region (suction-side or pressure-side surface) also decreases in each case; see above.

As an alternative to a blade element or vane body, the component in general may also involve, for example, a fairing. Likewise, channel plates (panels) can be smoothed and thus optimized with respect to the flow passing in the gas channel Preferably, however, the component is a blade element or vane body. In order to produce the relative movement between the liquid-solids mixture and the component, in general a nozzle could also be provided in the bath, through which the mixture will be pumped and thus will be accelerated onto the component. In this case, the latter would be considered in a stationary coordinate system, thus in the processing machine, and therefore, for example, also in the assembling or finishing facility.

In a preferred embodiment, however, the relative movement is achieved by moving the component through the liquid-solids mixture. Observed in a stationary coordinate system, it is the component that is moved; therefore, it is pushed or pulled through the mixture. In a preferred embodiment, in this case, the guide surfaces or guide unit/guide plate is or are moved together with the component through the bath. They can be arranged, for example, in a holder in which the component is placed and then the holder plus component will be moved through the mixture.

The liquid-solids mixture can be provided, for example, based on water.

Depending on the material of the component each time, the mixture may contain an acid, for example, e.g., hydrogen peroxide. Further, the liquid component may contain silicates, for example. The solids component is preferably provided as particles or in spherical form, in particular, in the form of glass or metal spheres. These spheres may have, for example, a diameter in the micron or millimeter range, approximately from at least 200 μm and, e.g., at most 2 mm, thus, for example, roughly 0.5 mm.

The invention also relates to a device for smoothing a component surface. The device has a container, in which the liquid-solids mixture can be placed or in which it will be kept. For smoothing, the component can be placed in the container. Further, the device has a movement mechanism, by means of which the relative movement between mixture and component can be produced, preferably by moving the component. Part of the device can thus be, in particular, a holder in which the component can be placed and then can be pulled through the container. Further, a guide surface, in particular a guide unit or guide plate, is found in the container. With respect to further details, reference is made explicitly to the preceding disclosure.

BRIEF DESCRIPTION OF THE DRAWINGS

The invention will be explained in more detail in the following on the basis of an example of embodiment, wherein the individual features in the scope of the independent, coordinated claims can also be essential to the invention in another combination, and wherein also no distinction is made individually between the different claim categories.

Taken individually.

DESCRIPTION OF THE INVENTION

Figure 1:
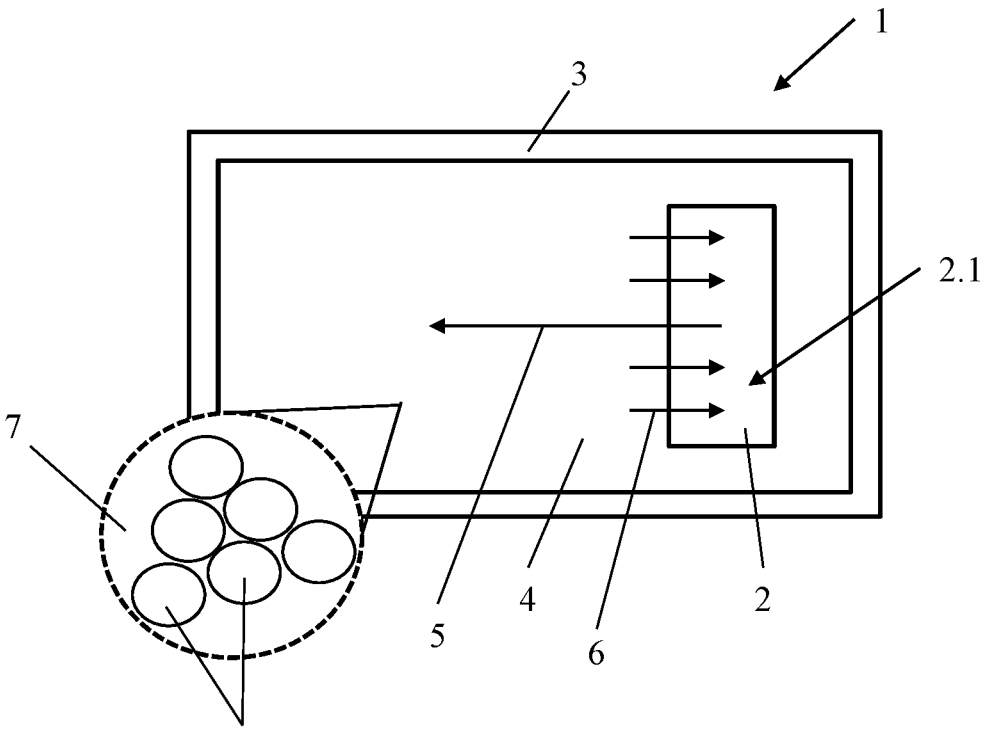
FIG. 1 shows a device for carrying out the method according to the invention in a schematic, partially excerpted lateral view.

FIG. 1 shows a device 1 for smoothing a component 2, concretely a surface 2.1 of the component 2. Component 2 presently involves a blade or a blade element of an aircraft engine; see also FIG. 3 for illustration. For the smoothing, the component 2 is or will be placed in a container 3 that is filled with a liquid-solids mixture 4.

The component 2 then will be moved in the liquid-solids mixture 4, a relative movement 5 thus being produced between the liquid-solids mixture 4 and the component 2. In this way, a flow 6 of the liquid-solids mixture 4 is established along the surface 2.1 of the component 2. As the enlarged excerpt illustrates, the mixture 4 is made up of a liquid constituent 7 (presently, e.g., water, $H_2O_2$, silicates) and sphere-shaped solids 8 with a diameter of e.g., 0.5 mm. If the mixture 4, due to the relative movement 5, flows along the surface 2.1, the spheres roll out on the surface 2.1 with a certain pressure.

Figure 2C:
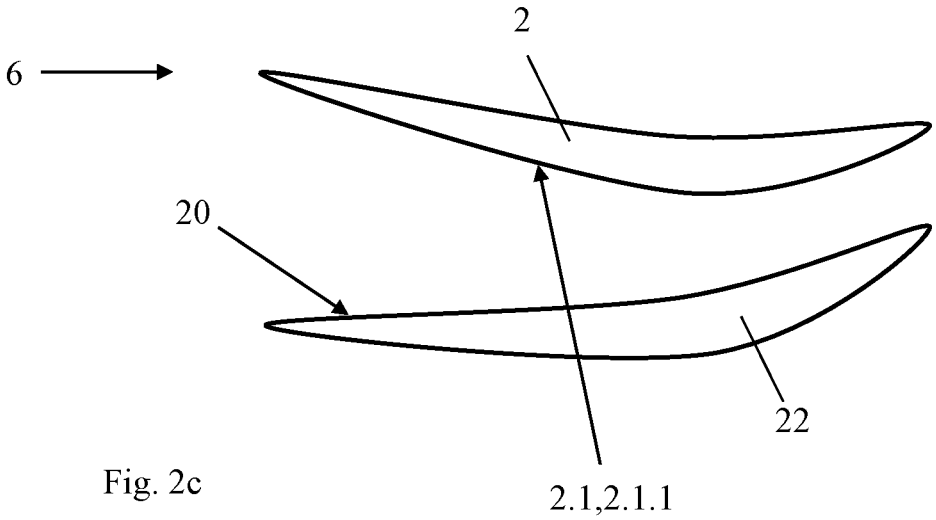
FIGS. 2*a-c* show different possibilities for the arrangement of guide surfaces or guide units for flow guidance in the device according to FIG. 1.
Figure 2A:
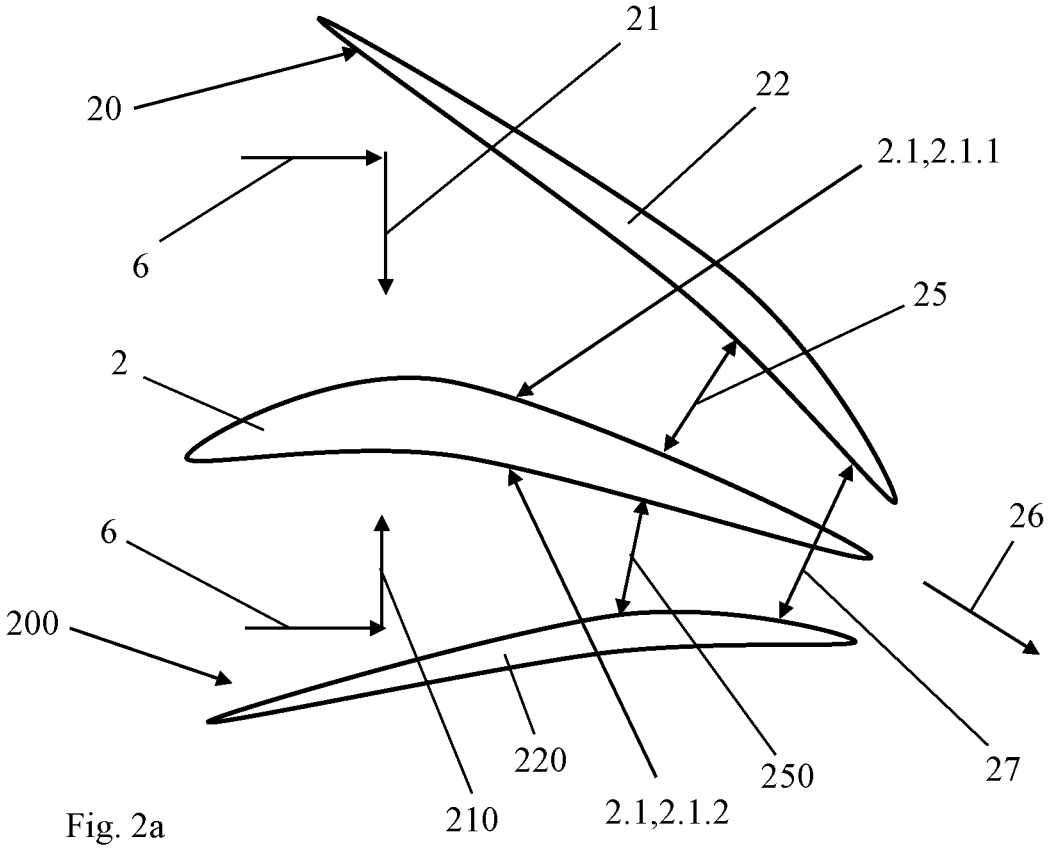
Figure 2B:
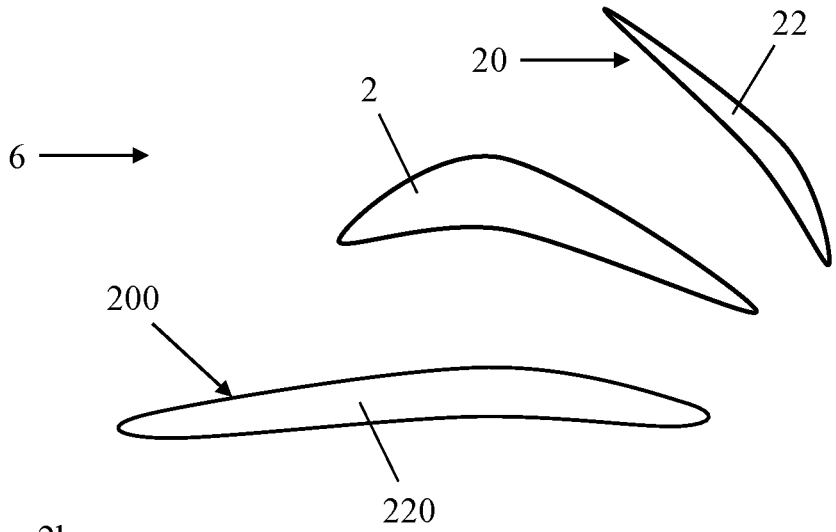

In order to obtain a more uniform pressure over the surface 2.1, according to the invention, a guide surface 20 is arranged in the mixture 4, and this guide surface imposes a directional component 21 on the flow 6 toward the surface 2.1 of the component 2. This is illustrated in FIGS. 2*a-c* (particularly in FIG. 2*a*), and in fact is illustrated each time in a section (referred to FIG. 1, the sectional plane lies perpendicular to the surface of the drawing and horizontal). The profile shape of the component 2, thus, e.g., of the blade element, can be recognized in these sections.

In the variant according to each of FIGS. 2*a, b*, yet another guide surface 200 is provided, which also imposes a directional component 210 on the flow 6 toward the component surface 2.1. Therefore, a guide surface 20, 200 is assigned to both a suction-side surface 2.1.1 and a pressure-side surface 2.1.2 of the blade element. Each of the guide surfaces 20, 200 is formed from a guide unit 22, 220, namely a guide plate flushed by the mixture 4.

The guide surfaces 20, 200 are arranged relative to the component 2 or its surface 2.1, so that a respective distance 25, 250 from the surface 2.1 decreases in the flow direction 26. Further, a distance 27 between the guide surfaces 20, 200 also decreases in the flow direction 26.

In the situation shown in FIG. 2*c*, in the case of the component 2, i.e., the blade element, the flow does not strike the leading edge thereof during the smoothing, but rather its trailing edge. Moreover, also in this case, only a single guide unit 22 with the guide surface 20 finds application, this unit being assigned to the suction-side surface 2.1.1 of the component 2. In general, FIGS. 2*a-c* illustrate different possibilities and options.

Figure 3:
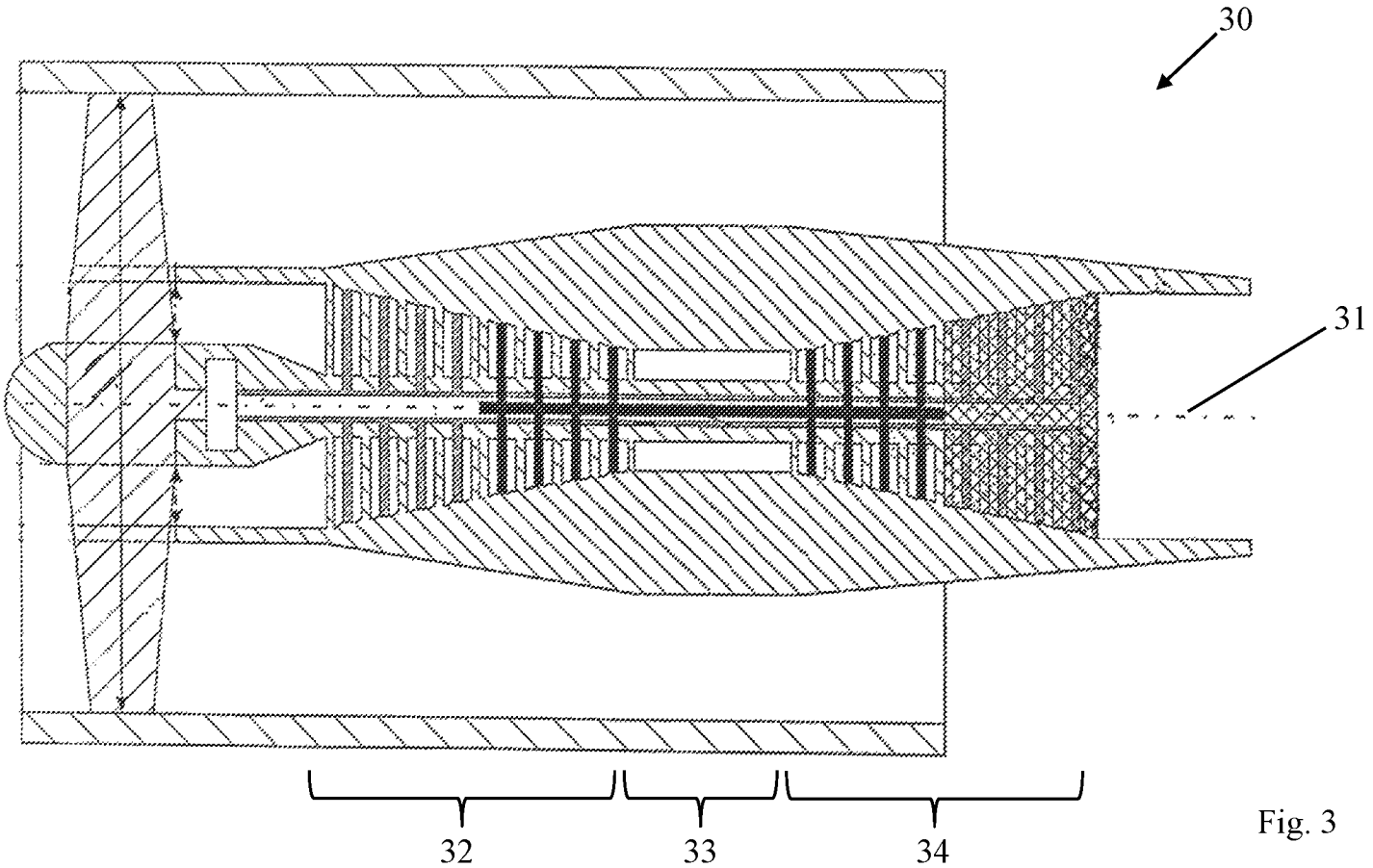
FIG. 3 shows an engine in an axial section for illustration of possible applications.

FIG. 3 shows a turbomachine 30, concretely a turbofan engine, in an axial section (the sectional plane contains the longitudinal axis 31). Functionally, the turbomachine 30 is divided into compressor 32, combustion chamber 33, and turbine 34, wherein air aspirated in the compressor 32 is compressed. With kerosene mixed in, it is then combusted in the combustion chamber 33, and the arising hot gas is expanded in the turbine 34. Both the compressor 32 and the turbine 34 are each constructed in multiple stages. The component 2 (the smoothed blade element according to the preceding description) can find application both in the turbine 34 and the compressor 32, the latter being preferred (due to the high aerodynamic specifications therein).

What is claimed is:

1. A method for smoothing a surface of a component, comprising the steps of:

placing the component in a liquid-solids mixture;

producing a relative movement between the liquid-solids mixture and the component;

providing a flow of the liquid-solids mixture along the surface;

wherein there is provided in the liquid-solids mixture a guide surface, along which the liquid-solids mixture flows, wherein a directional component toward the surface is imposed on the flow;

wherein the surface of the component comprises a suction-side surface and a pressure-side surface, wherein the guide surface is assigned to both the suction-side surface and the pressure-side surface in the liquid-solids mixture.

2. The method according to claim 1, wherein the guide surface is a lateral surface of a guide unit that is subject to flow in the liquid-solids mixture, wherein the liquid-solids mixture thus also flows along a lateral surfaces opposite the guide surface.

3. The method according to claim 1, wherein the surface of the component has a curved course when observed in a sectional plane, and the guide surface has a complementary curved course when observed in the same sectional plane.

4. The method according to claim 1, wherein the guide surface is arranged relative to the surface wherein a distance that is taken perpendicular to a flow line profile between the component surface and the guide surface, when observed in a sectional plane, decreases in the flow direction.

5. The method according to claim 1, wherein an additional guide surface is provided in the liquid-solids mixture, along which guide surface the liquid-solids mixture flows, wherein the component is arranged between the guide surfaces.

6. The method according to claim 5, wherein the guide surfaces are arranged relative to each other in such a way that a distance between the guide surfaces that is taken perpendicular to a flow-line profile between the guide surfaces, when observed in a sectional plane, decreases in the flow direction.

7. The method according to claim 1, wherein the component is configured and arranged in a gas channel of a turbomachine, wherein the surface is an upper surface facing the gas channel.

8. The method according to claim 7, wherein the component is a blade element or vane body for the turbomachine.

9. The method according to claim 1, wherein, in order to produce the relative movement in a stationary coordinate system, the component is moved through the liquid-solids mixture.

10. The method according to claim 9, wherein the guide surface or guide surfaces are moved together with the component through the liquid-solids mixture.

11. The method according to claim 1, wherein the liquid-solids mixture is provided with sphere-shaped solids.

12. The method according to claim 1, further comprising the steps of:

providing a container for holding the liquid-solids mixture and for arranging the component;

providing a movement mechanism for producing the relative movement between the liquid-solids mixture and the component;

providing a guide surface in the container, in order to impose on the flow the directional component toward the surface.

* * * * *